US008201389B2

(12) United States Patent
Eleftheriou et al.

(10) Patent No.: US 8,201,389 B2
(45) Date of Patent: Jun. 19, 2012

(54) OIL DISTRIBUTING UNIT

(75) Inventors: Andreas Eleftheriou, Woodbridge (CA); David Denis, Burlington (CA); Brent Hayward, Toronto (CA); David H. Menheere, Georgetown (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1412 days.

(21) Appl. No.: 11/543,793

(22) Filed: Oct. 6, 2006

(65) Prior Publication Data

US 2008/0083227 A1 Apr. 10, 2008

(51) Int. Cl.
*F02C 7/06* (2006.01)

(52) U.S. Cl. ..... 60/39.08

(58) Field of Classification Search ..... 60/39.08; 184/6.11; 384/462; 415/110–111, 229
See application file for complete search history.

(56) References Cited

U.S. PATENT DOCUMENTS

| | | | | |
|---|---|---|---|---|
| 3,078,667 | A * | 2/1963 | Deinhardt | 60/39.08 |
| 4,144,950 | A | 3/1979 | Moyer et al. | |
| 4,170,873 | A * | 10/1979 | Milo | 60/39.08 |
| 4,265,334 | A | 5/1981 | Benhase, Jr. | |
| 4,858,427 | A * | 8/1989 | Provenzano | 60/39.08 |
| 4,891,934 | A | 1/1990 | Huelster | |
| 4,976,335 | A * | 12/1990 | Cappellato | 184/6.4 |
| 5,163,757 | A | 11/1992 | Graham | |
| 5,323,610 | A | 6/1994 | Fransson et al. | |
| 5,568,984 | A * | 10/1996 | Williams | 384/475 |
| 5,813,214 | A | 9/1998 | Moniz et al. | |
| 6,640,933 | B2 | 11/2003 | Henry et al. | |
| 6,682,222 | B2 | 1/2004 | Fisher | |
| 7,070,333 | B2 | 7/2006 | Ito et al. | |
| 2006/0076193 | A1 * | 4/2006 | Ruther et al. | 184/6.12 |
| 2009/0133581 | A1 * | 5/2009 | Fang et al. | 96/216 |

FOREIGN PATENT DOCUMENTS

WO WO 2004092639 A2 * 10/2004 ..... 184/6.12

* cited by examiner

*Primary Examiner* — Louis Casaregola
*Assistant Examiner* — Phutthiwat Wongwian
(74) *Attorney, Agent, or Firm* — Norton Rose Canada LLP

(57) ABSTRACT

A single oil nozzle unit is mounted in a bearing compartment of a gas turbine engine for providing multiple individual jets for the individual bearing components in the bearing compartment.

15 Claims, 5 Drawing Sheets

OIL DISTRIBUTING UNIT

TECHNICAL FIELD

The invention relates generally to gas turbine engine and, more particularly, to a single oil nozzle assembly for multiple individual parts of a gas turbine engine.

BACKGROUND OF THE ART

Gas turbine engines generally include multiple bearing compartments with both static and rotating components therein. In order to lubricate various components in each bearing compartment an oil gallery is typically provided in a cast passage that is then drilled and tapped in multiple spots to feed multiple nozzles. Thus, the lubrication of multiple components is carried out by individual oil nozzles respectively. Typically, each individual nozzle requires one or two fasteners, tab washers and a sealing packing for attachment in the engine thereby requiring an individual attachment site per nozzle. In the case of a small bearing compartment having more than one bearing and up to 4 or 5 components that need to be lubricated, space is very limited therefore attaching multiple individual nozzles becomes problematic. Thus, limiting the number of attachment sites required for mounting oil nozzles is necessary. Furthermore, it is desirable to save weight and overall cost by reducing the number of parts required to carry out the oil distribution in the engine.

Accordingly, there is a need to provide an oil distributing unit that addresses at least some of the above issues.

SUMMARY OF THE INVENTION

It is therefore an object of this invention to provide an oil distributing unit adapted to feed multiple individual components.

In one aspect, the present invention provides an oil distributing unit for a bearing compartment in a gas turbine engine, comprising a central body having an attachment feature adapted for attachment to a main oil supply, the central body having one inlet port for communicating with the main oil supply, at least one outlet transfer port adapted for directing oil to an additional oil system in the gas turbine engine, and multiple nozzles for directly lubricating multiple bearing components in the bearing compartment.

In a second aspect, the present invention provides an oil system for a gas turbine engine comprising a main oil supply in a bearing compartment of the engine, an oil distributing unit attached to the main oil supply having a single inlet in flow communication therewith, the oil distributing unit having a central body branching into at least one outlet transfer port for directing oil to an additional oil system in the gas turbine engine and multiple nozzles for directly lubricating multiple bearing components in the bearing compartment.

In a third aspect, the present invention provides a method of manufacturing an oil distributing unit for a bearing compartment in a gas turbine engine, comprising integrally casting a central body and multiple branches and sub branches extending therefrom, straight drilling an inlet in the central body and straight drilling multiple outlets in the multiple branches and sub branches permitting oil distribution from the inlet to the multiple outlets.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
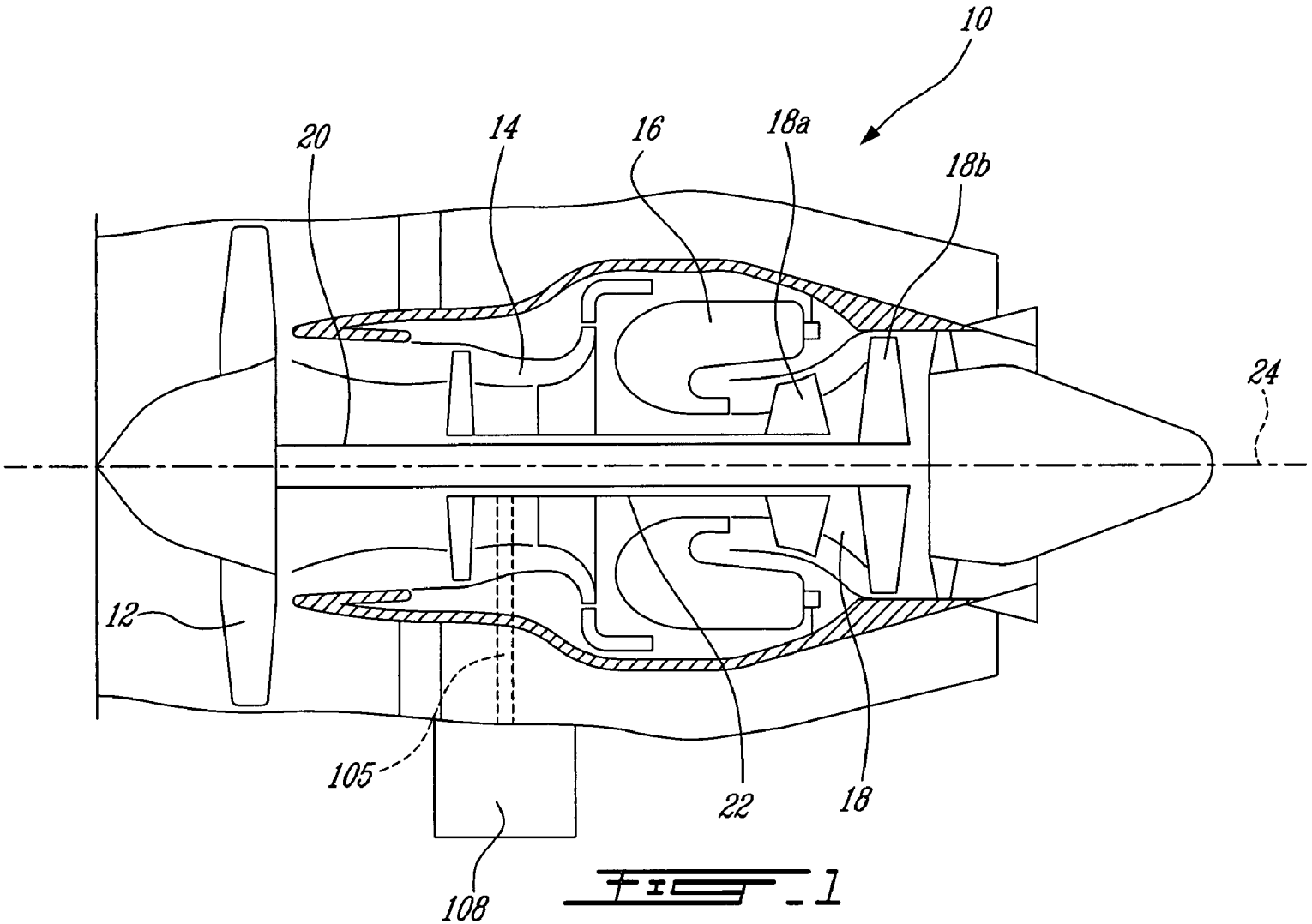
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
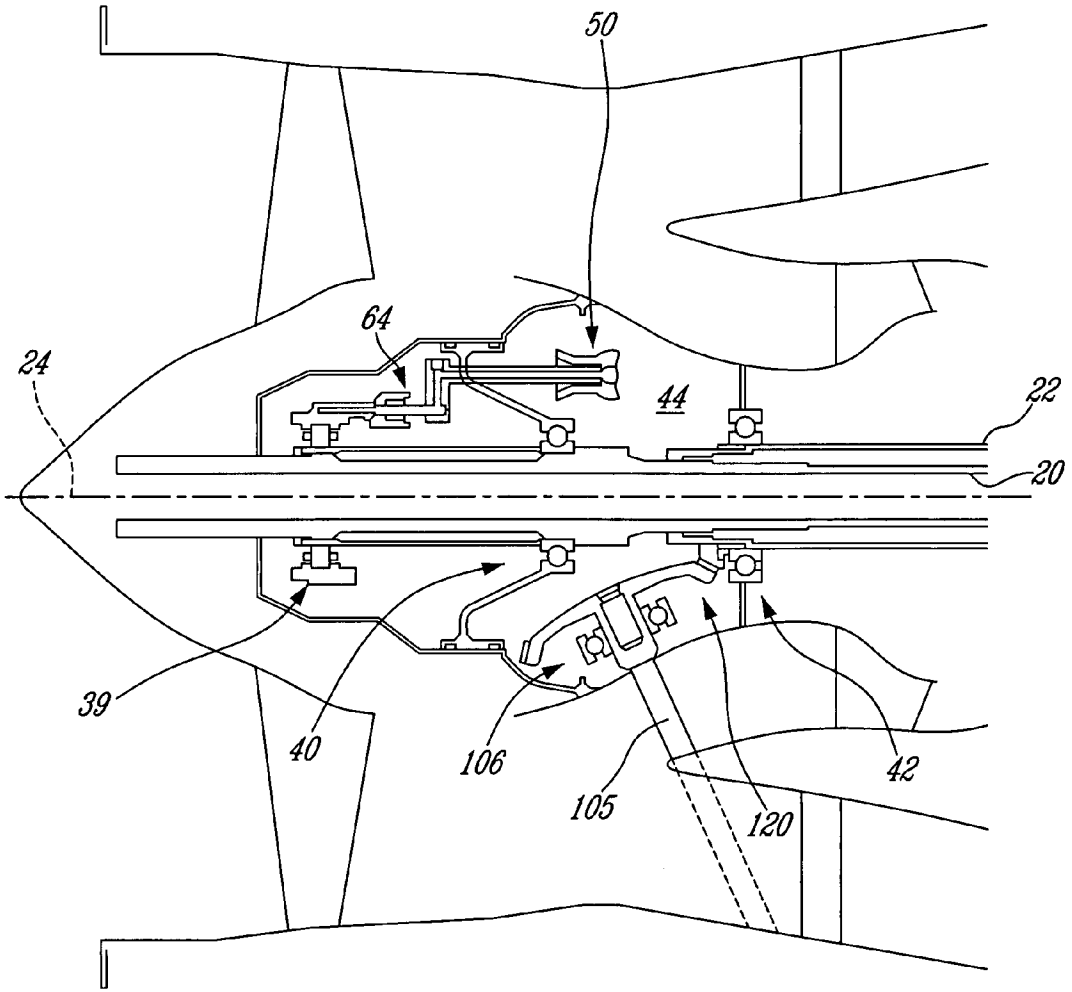
FIG. 2 is an enlarged schematic cross-sectional view of the fan and compressor section of the gas turbine engine, illustrating the emplacement of the No. 1 bearing, No. 2 bearing, the No. 3 bearing, the upper towershaft (UTS) gear mesh and the UTS bearing of the gas turbine engine shown in FIG. 1.

Generally, the gas turbine engine 10 comprises a low pressure shaft 20 and a high pressure shaft 22 concentrically mounted about an engine centerline 24 as shown in FIGS. 1 and 2. The low pressure (LP) shaft 20 connects a low pressure turbine (LPT) 18*b* to fan 12, and the high pressure (HP) shaft 22 connects a high pressure turbine (HPT) 18*a* to the high pressure compressor (HPC) 14. Both high and low pressure rotor assemblies include multiple components. A tower shaft 105 is in meshing engagement with the high pressure shaft 22 to drive an accessory gearbox (AGB) 108, as well known in the art.

FIG. 2 shows three bearings 39, 40 and 42 respectively commonly referred to as the No. 1, No. 2 and No. 3 bearings of the engine 10. In the illustrated example, the No. 2 and No. 3 bearings (bearings 40 and 42) are located in a same bearing compartment 44. The No. 1 bearing (bearing 39) is located in a separate compartment. However, it is understood that all three bearings 39, 40 and 42 could be located in a common bearing compartment. The No. 1 and No. 2 bearings (bearing 39 and 40) provide support to the LP shaft 20, whereas the No. 3 bearing (bearing 42) provides support to the HP shaft 22.

The bearing compartment 44 houses other components, such as upper tower shaft bearing 106 and the upper tower shaft gear mesh 120, that also need to be lubricated. The space available in the bearing compartment 44 to house all these components and bearings is very limited.

Figure 3:
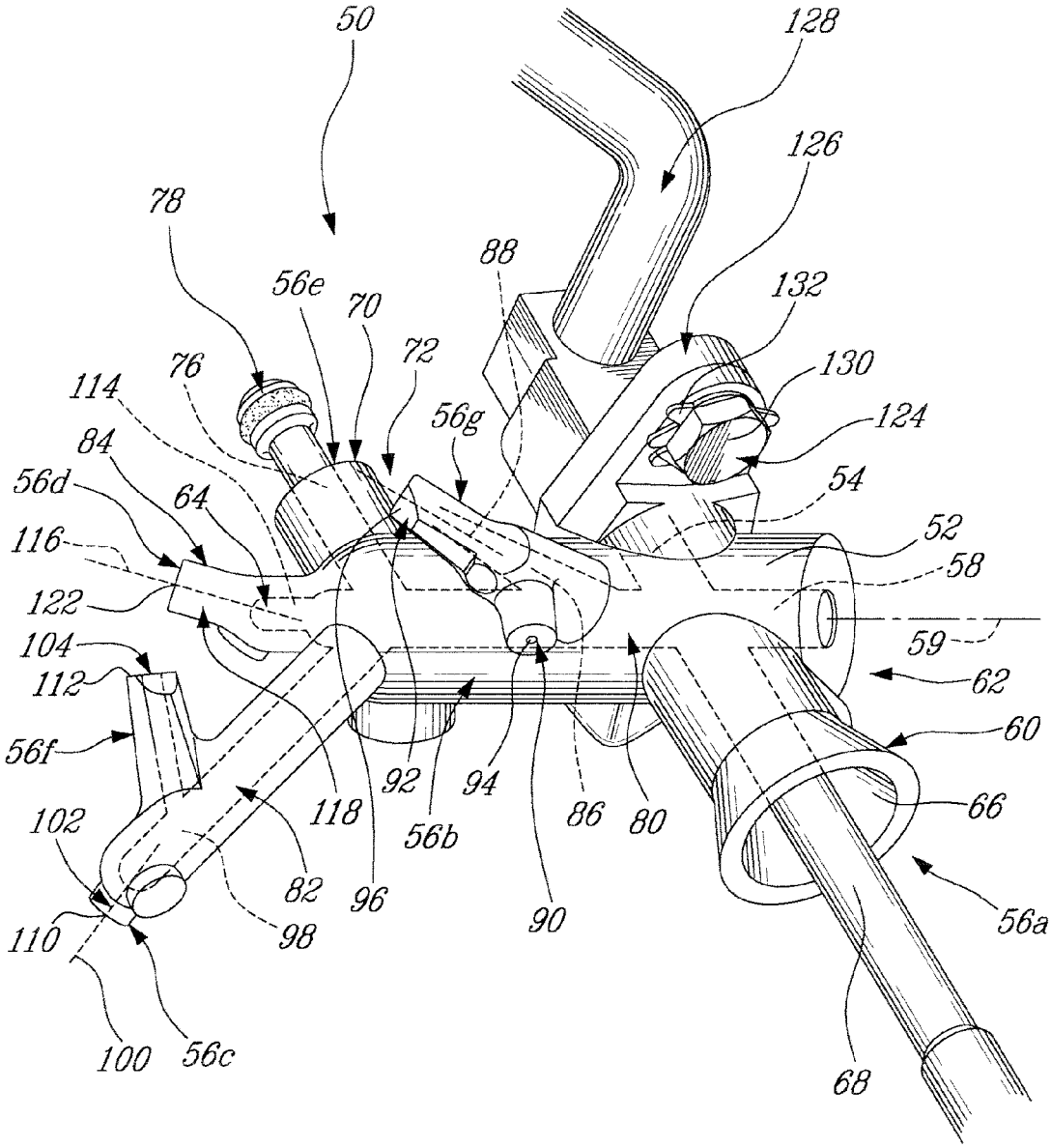
FIG. 3 is a perspective view of an oil distributing unit for providing individual jets for the No. 1, No. 2 & No. 3 bearings, the UTS gear mesh and the UTS bearing shown in FIG. 2.

As shown in FIGS. 2 and 3, an oil distributing unit 50 is mounted in the bearing compartment 44 in accordance with a particular embodiment of the present invention. The oil distributing unit 50 comprises a central body 52 having a single inlet port 54 in fluid communication with multiple outlet ports 56*a*, 56*b*, 56*c* . . . . The oil distributing unit 50 is configured for fitting into the bearing compartment 44 having a three dimensional shape accommodating the tight clearances between the various static and rotating components.

Figure 4:
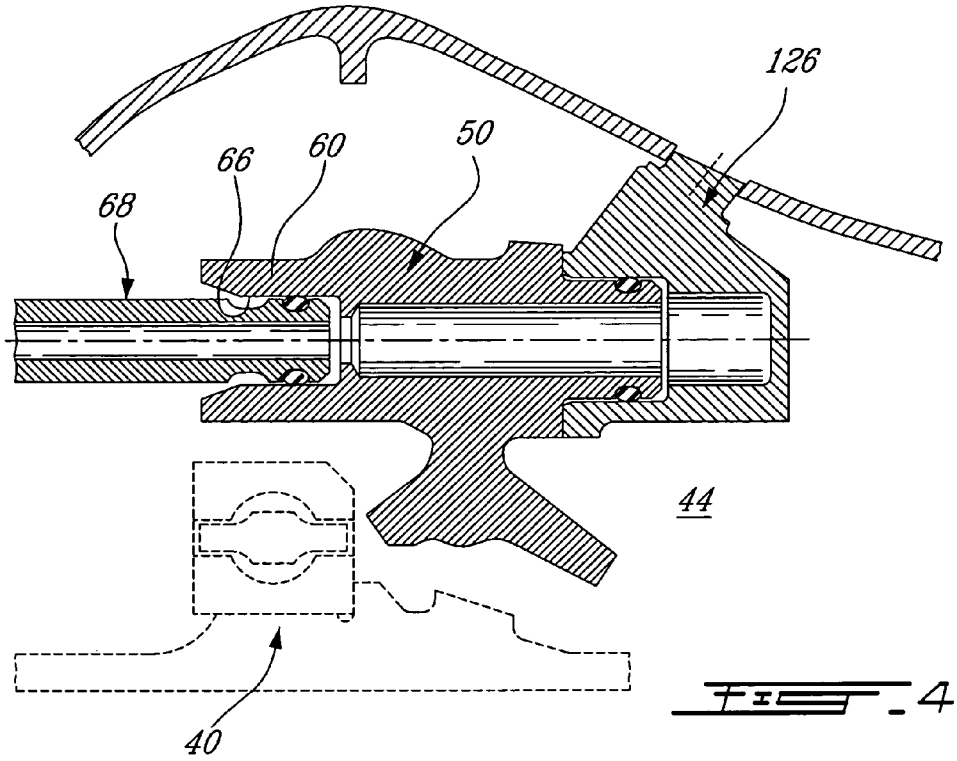
FIG. 4 is a cross-sectional view showing an outlet transfer port of the oil distribution unit attached to a first transfer tube for directing oil forward to No. 1 bearing of the gas turbine engine shown in FIG. 1.

More particularly, the central body 52 has an elongated cylindrical shape defining a central conduit 58 along a line of sight 59 as shown in FIG. 3. The central conduit 58 is in fluid communication with the inlet port 54. A first transfer port 60 extends from a first end 62 of the central body 52 in fluid communication with central conduit 58. The first transfer port 60 is adapted to direct a flow of oil forward to a first additional oil system including the No. 1 bearing 39 and associated damper 64 (FIGS. 2 and 4). Particularly, the first transfer port 60 includes a bore 66 for receiving a first transfer tube 68 attached therein as shown in FIGS. 3 and 4.

Figure 5:
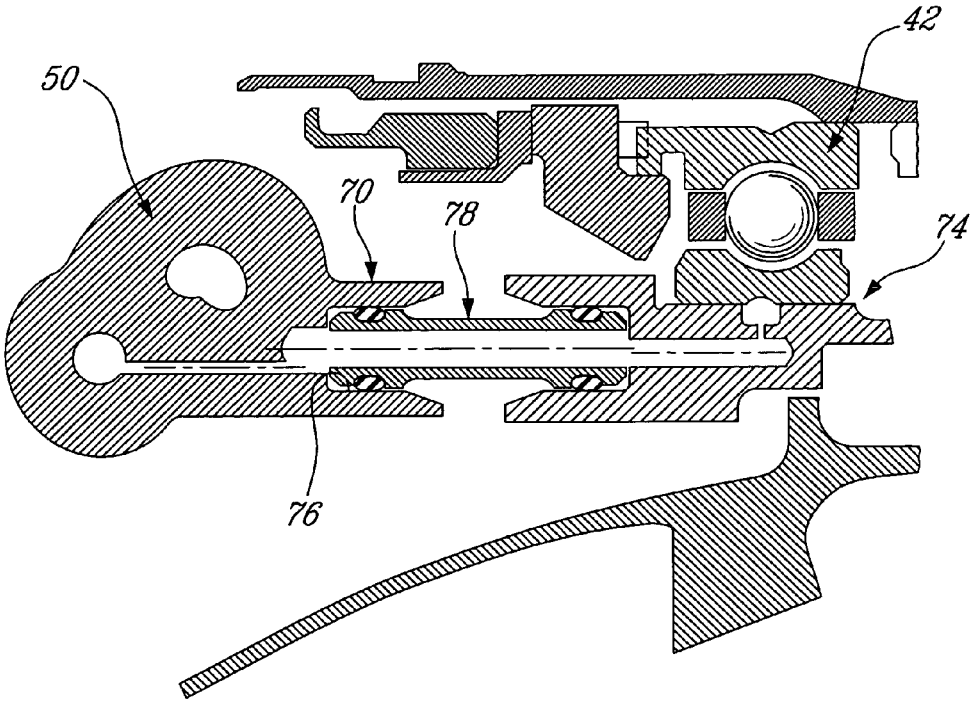
FIG. 5 is a cross-sectional view showing another outlet transfer port of the oil distribution unit attached to a second transfer tube for directing oil rearward to the No. 3 bearing damper of the gas turbine engine shown in FIG. 1.

Similarly, a second transfer port 70 extends from a second end 72 of the central body 52 in fluid communication with central conduit 58. The second transfer port 70 is adapted to direct a flow of oil rearward to a second additional oil system shown as the No. 3 bearing damper 74 in FIG. 5. Particularly, the second transfer port 70 includes a bore 76 for receiving a second transfer tube 78 attached therein as shown in FIGS. 3 and 5.

Figure 6:
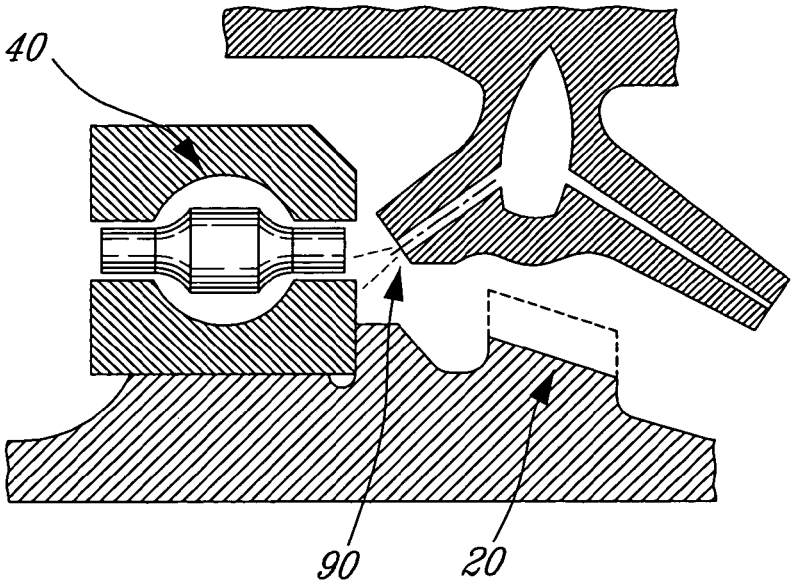
FIG. 6 is a cross-sectional view of a portion of the oil distributing unit of FIG. 2, showing a nozzle thereof in spaced relation with the No. 2 bearing of the gas turbine engine shown in FIG. 1.

Still referring to FIG. 3, the oil distributing unit 50 further comprises first, second and third cylindrical members 80, 82 and 84 respectively extending from the central body 52 in different three-dimensional directions determined by the location of the components in the bearing compartment 44 which require lubrication. The first member 80 defines conduit 86 extending along a line of sight 88 and in fluid communication with the central conduit 58. The first member 80 branches off into first and second nozzles 90 and 92 adapted for spraying the No. 2 bearing 40, as shown in FIG. 6, and the No. 3 bearing 42 respectively. Each nozzle 90 and 92 defines a spray orifice 94 and 96 respectively that communicates with conduit 86 of the first member 80.

Figure 7:
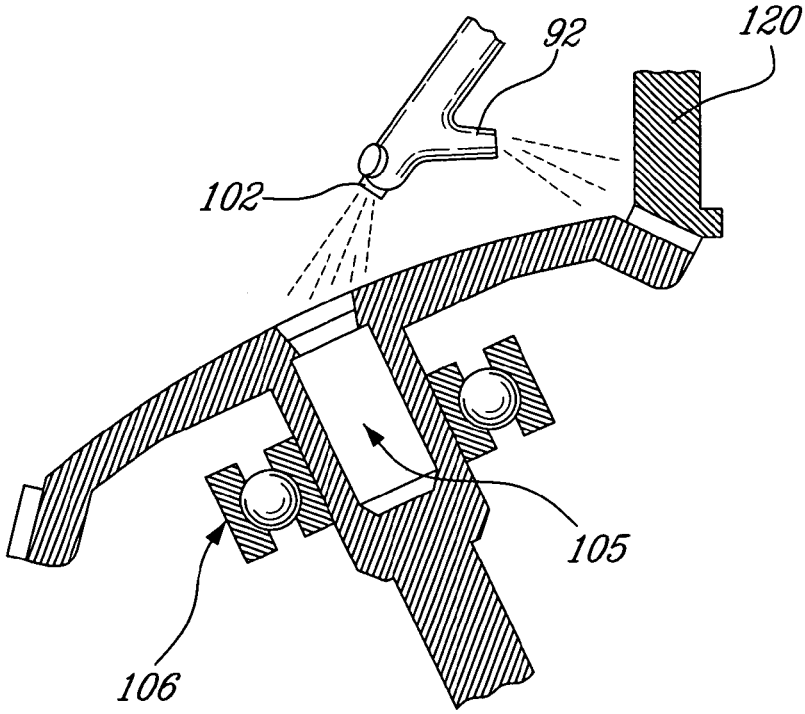
FIG. 7 is a cross-sectional view of a portion of the oil distributing unit of FIG. 2, showing another nozzle thereof in spaced relation with an upper towershaft bearing of the gas turbine engine of FIG. 1.

The second member 82 similarly defines conduit 98 extending along a line of sight 100 and in fluid communication with the central conduit 58. The second member 82 branches off into first and second nozzles 102 and 104 adapted for spraying the upper towershaft (UTS) bearing 106, as shown in FIG. 7, and the No. 3 bearing 44 respectively. Each nozzle 102 and 104 defines a spray orifice 110 and 112 respectively that communicates with conduit 98 of the second member 82.

The third member 84 similarly defines conduit 114 extending along a line of sight 116 and in fluid communication with the central conduit 58. The third member 84 branches off into nozzle 118 adapted for spraying the upper towershaft (UTS) gearmesh 120. Nozzle 118 defines a spray orifice 122 that communicates with conduit 114 of the third member 84.

It should be understood that the nozzles 90, 92, 102, 104 and 118 of the oil distributing unit 50 are spaced from the respective components in the bearing compartment 44 a predetermined clearance for optimizing the use of space in the compartment 44 and for ensuring proper lubrication.

Still referring to FIG. 3, the oil distributing unit 50 further comprises an attachment feature 124 for mating engagement with a corresponding feature 126 at attachment site 128 adjacent a main oil supply feed line 128. The attachment feature 124 connects the inlet port 54 to the main oil supply feed line 128. More specifically, the attachment feature 124 is exemplified as a bolt 130, tab washer 132, pin (not shown) and packing (not shown).

In operation, the main oil supply feed line 128 of the engine 10 supplies a continuous flow of oil to the oil distributing unit 50 through inlet port 54. The flow of oil travels through the central conduit 58 defined in the central body 52 and subsequently branches out to first, second and third conduits 86, 98 and 114 to spray the components requiring lubrication. The flow of oil is also directed forward and rearward through first and second transfer ports to additional oil systems as described above. Notably, the flow rate is controlled by the diameter of the ports, conduits and orifices. The oil flow rate is preferably maintained below 10 ft/s so as to avoid cavitations.

The oil distributing unit 50 presented above advantageously combines nozzles that were previously individual components and transfer ports for directing oil to additional oil systems. Such a combination of outlets into one unit that is fed by a single inlet reduces overall part count as a single attachment feature is required.

Furthermore, the oil distributing unit 50 above-described is manufactured in accordance with a particular method of the present invention. The oil distributing unit 50 is cast as a single piece having a predetermined geometry that enables the unit 50 to be assembled in the bearing compartment 44 of the engine 10. Notably the oil distributing unit 50 is cast in a light weight aluminium material. The conduits 58, 86, 98 and 114 are preferable drilled along the respective line of sites 60, 88, 100 and 116 and then plugged to ensure that the oil flow is distributed to the nozzles. Similarly, the inlet 54 and bores 66 and 76 of transfer ports 60 and 70 are straight drilled to tap off of the central conduit 58

The method of manufacturing presented above is advantageous because the use of cores during casting to cast core passages is avoided as the latter tend to shift, trap dirt or are difficult to clean. In the case of ceramic cores that generally do not move, a time consuming etching process for removal thereof is required. In the above method, simple straight drilling is done to machine the conduits, thus time is saved in manufacturing the oil distributing unit.

The above description is meant to be exemplary only, and one skilled in the art will recognize that changes may be made to the embodiments described without department from the scope of the invention disclosed. For example, the oil distributing unit may be configured to direct oil to any number of additional oil systems and may comprises any number of nozzles for lubricating components in the bearing compartment in which the unit is provided. Still other modifications which fall within the scope of the present invention will be apparent to those skilled in the art, in light of a review of this disclosure, and such modifications are intended to fall within the appended claims.

What is claimed is:

1. A gas turbine engine lubrication system comprising at least first and second bearing compartments of a gas turbine engine, said first bearing compartment housing multiple bearing components; the system further comprising a main oil supply; and an oil distributing unit having a central body mounted in said first bearing compartment and having one inlet port connected in flow communication with the main oil supply, the central body defining a central conduit connected to said inlet port, the oil distributing unit having at least one outlet transfer port branching off from said central conduit and connected to a transfer tube extending into said second bearing compartment for supplying oil to a bearing component housed in the second bearing compartment, the oil distributing unit further having multiple nozzles branching off from the central conduit of the central body and pointing to different bearing components in the first bearing compartment for lubricating the multiple bearing components housed in the first bearing compartment from said central body.

2. The lubrication system defined in claim 1, further comprising multiple members extending in different directions from the central body, each member being provided with at least one of said multiple nozzles which are oriented in diverging directions.

3. The lubrication system defined in claim 2, wherein at least one of said members branch into two differently oriented nozzles for directing oil jets against different components.

4. The lubrication system defined in claim 2, wherein the central body has an elongated shape, the central conduit being linear, and the multiple members define respective directional conduits in fluid flow communication with the linear central conduit.

5. The lubrication system defined in claim 4, wherein the inlet port, the outlet transfer port and the multiple members define respective axes intersecting an axis of the central conduit.

6. The lubrication system defined in claim 1, wherein the outlet transfer port defines a bore adapted for receiving the transfer tube.

7. The lubrication system defined in claim 6, comprising a first outlet transfer port adapted to direct oil forward through a first transfer tube and a second outlet transfer port adapted to direct oil rearward through a second transfer tube to respective additional oil systems in the gas turbine engine.

8. A gas turbine engine bearing compartment lubrication arrangement comprising a bearing compartment housing multiple individual components requiring lubrication, the multiple individual components including first and second bearings mounted at spaced-apart locations along a gas turbine engine shaft, a main oil supply, a single oil nozzle unit mounted in the bearing compartment and having an inlet in flow communication with the main oil supply, the single oil nozzle unit having a central body branching into multiple differently oriented nozzles and facing respective ones of the multiple individual components for directly lubricating the multiple individual components from said single oil nozzle unit in the bearing compartment, a first one of said multiple differently oriented nozzles providing oil to the first bearing, whereas a second one of the multiple differently oriented nozzles provides oil to the second bearing.

9. The lubrication arrangement defined in claim 8, wherein said oil nozzle unit has at least one outlet transfer port connected to a transfer tube connected to an additional oil system located outside of the bearing compartment in the gas turbine engine.

10. The lubrication arrangement defined in claim 8, wherein the oil nozzle unit comprises multiple members extending in different directions from the central body, at least one of said members branching into at least two of said multiple nozzles.

11. The lubrication arrangement defined in claim 10, wherein the central body has an elongated shape defining a linear central conduit, and the multiple members define respective directional conduits in fluid flow communication with the linear central conduit.

12. The lubrication arrangement defined in claim 11, wherein the inlet port and the multiple members define respective axes intersecting an axis of the central conduit.

13. The lubrication arrangement defined in claim 12, wherein the multiple nozzles are respectively directed at a No. 2 bearing, a No. 3 bearing, an upper towershaft bearing and an upper towershaft gearmesh in the bearing compartment of the gas turbine engine.

14. The lubrication arrangement defined in claim 8, wherein the oil nozzle unit comprises a first outlet transfer port directing oil forward through a first transfer tube and a second outlet transfer port directing oil rearward through a second transfer tube to respective additional oil systems in the gas turbine engine.

15. The lubrication arrangement defined in claim 14, wherein the forward additional oil system is a No. 1 bearing jet and damper of the gas turbine engine.

* * * * *